US006421988B1

(12) United States Patent
Chiu

(10) Patent No.: US 6,421,988 B1
(45) Date of Patent: Jul. 23, 2002

(54) AUTOMATIC PACKING SEALING AND CUTTING MACHINE FOR PLASTIC FILM

(76) Inventor: Shao-Yi Chiu, P.O. Box 82-144, Taipei (TW)

( * ) Notice: Subject to any disclaimer, the term of this patent is extended or adjusted under 35 U.S.C. 154(b) by 0 days.

(21) Appl. No.: 09/451,717

(22) Filed: Dec. 1, 1999

(51) Int. Cl.[7] ..... B65B 9/06; B65B 41/00

(52) U.S. Cl. ..... 53/568; 53/133.8; 53/141; 53/389.4; 83/660

(58) Field of Search ..... 53/141, 133.8, 53/373.4, 568, 389.4; 83/599, 660, 682, 698.41

(56) References Cited

U.S. PATENT DOCUMENTS

| | | | | | |
|---|---|---|---|---|---|
| 2,860,555 | A | * | 11/1958 | Williamson | 83/599 |
| 3,323,282 | A | * | 6/1967 | Duns | 53/568 |
| 3,354,605 | A | * | 11/1967 | Amberg | 53/133.8 |
| 3,389,626 | A | * | 6/1968 | Wise | 83/660 |
| 3,420,034 | A | * | 1/1969 | Saraisky | 53/373.4 |
| 3,470,795 | A | * | 10/1969 | Davis | 53/373.4 |
| 3,684,142 | A | * | 8/1972 | Jackson | 83/660 |
| 3,685,251 | A | * | 8/1972 | Mahaffy | 53/373.4 |
| 4,715,250 | A | * | 12/1987 | Roseman | 83/498.41 |
| 4,768,411 | A | * | 9/1988 | Su | 53/373.4 |
| 5,372,494 | A | * | 12/1994 | Vaughan | 83/660 |
| 5,381,640 | A | * | 1/1995 | Chiu | 53/374.9 |
| 5,423,162 | A | * | 6/1995 | Chiu | 53/562 |
| 5,816,301 | A | * | 10/1998 | Stager | 83/698.41 |
| 5,842,320 | A | * | 12/1998 | Chiu | 53/141 |
| 5,966,898 | A | * | 10/1999 | Su | 53/568 |

FOREIGN PATENT DOCUMENTS

| | | | | |
|---|---|---|---|---|
| JP | 6-32330 | * | 6/1994 | 83/599 |

* cited by examiner

*Primary Examiner*—John Sipos
(74) *Attorney, Agent, or Firm*—Leong C. Lei

(57) ABSTRACT

The present invention relates to a packing, sealing and cutting machine for plastic film comprising a film-delivery device mounted with a film tension adjusting button and a rolling needle delivery shaft such that the film is provided with a plurality of holes during the delivering of the film. A separation rod and an electrostatic elimination rod are provided along the path of the delivering of the film so that the delivery of the film is smooth. The front delivery seat is positioned by a teethed rack to adjust the movement of the packed object. The sealing and cutting knife driving device drive the vertical and horizontal knife to seal and to cut the film after an object is packed.

1 Claim, 16 Drawing Sheets

AUTOMATIC PACKING SEALING AND CUTTING MACHINE FOR PLASTIC FILM

BACKGROUND OF THE INVENTION (a) Technical Field of the Invention

The present invention relates to an automatic packing, sealing and cutting machine for plastic film, and in particular, to a packing machine using plastic film, having a film-delivery device including a film-tension adjusting device, a rolling needle wheel, a separation rod, an electrostatic eliminating rod and a sliding movement adjusting device, an elevation rod, an air blowing device and film-pulling wheel, a sensing device and a sealing and cutting knife driving device.

(b) Description of the Prior Art

FIG. 1 shows a conventional automatic packing, sealing and cutting device for plastic film comprising a machine frame 1, a film-holding frame 2, a film-guiding rod 3, a front delivery seat 4, an upper and lower triangular board 5, an upper triangular board adjusting seat, a sealing and cutting knife 6, a rear delivery seat 7, a waste collection wheel and a control system 8, wherein the plastic film 9 is located on the film-holding flame 2 and the film 9 passes through the film-guiding rod 2 such that the film is flat in the process of delivery. The film 9 is extended to open by the upper and the lower triangular board 5 such that the plastic film encloses a storage space. After that the plastic film is clipped by the clipping chain at the rear delivery seat 7. The to-be delivered object is placed at the front delivery belt of the front delivery seat 4. By means of the delivery belt the object is delivered to the rear delivery seat 7. By the sensing of the electronic sensor, the control system 8 drives the sealing and cutting knife 6 to seal and cut the plastic film 9, and the real delivery belt transports out the packed, sealed object. The waste plastic film 9 is collected by the waste collection wheel. If a taller object is to be packed, the height of the triangular board is adjusted by means of the triangular board adjusting seat such that the object can pass through and there is enough plastic film 9 for packing.

SUMMARY OF THE PRESENT INVENTION

Accordingly, an object of the present invention is to provide an automatic packing, sealing, and cutting machine for plastic film comprising a film delivery device, a front conveying seat device, a rear conveying seat device, a sealing and cutting knife and a control box, wherein (a) the adjusting seat 60 is a rotating body and includes a rotating wheel 601 to rotate a screw rod 602, and a frame seat 604 located at the screw rod 602 is moved accordingly, and the bottom end of the seat 60 is provided with a securing rotating disc 603 for the mounting of the frame seat 604;

(b) the air pressure cylinder 61 has an end terminal pivotally mounted at the frame seat 604 and the air pressure rod 610 at the front end thereof passes the linking rod 611 and then secured to the rotating shaft 62;

(c) the rotating shaft 62 is pivotally mounted to the shaft rod within the machine;

(d) the interlinking arm 63 is mounted at the two lateral sides of the rotating shaft 62 and has an arm 630 with two protruded ends;

(e) the rod 64 has one end pivotally mounted at the arm 640 and has the other end pivotally connected to the sealing, cutting knife;

(f) a sealing, cutting knife is used to seal and cut the contracted film, and has one side being provided with an external protruded disc.

In accordance with the present invention, the adjusting seat 60 is mounted at the bottom end of the machine and the adjusting seat 60 is mounted onto the rotating shaft via the air pressure cylinder 61, the interlinking rod 610, so that the front and rear displacement of the air pressure rod 61 drives the interlinking rod 611 and a swinging movement is formed, and the rotating shaft 62 is reciprocating. Thus the interlinking arm 63 at the side of the rotating shaft 62 will reciprocate. As a result, when the four corresponding rods 64 are respectively mounted at the arm 631 and the upper and lower end of the sealing, cutting seat, the rod 64 will rotate in relation to the interlinking arm 63 so as to produce a pulling and a pushing force, and the sealing and cutting seat forms a continuing open and closing type of sealing and cutting action.

DETAILED DESCRIPTION OF THE PRESENT INVENTION

Figure 1:
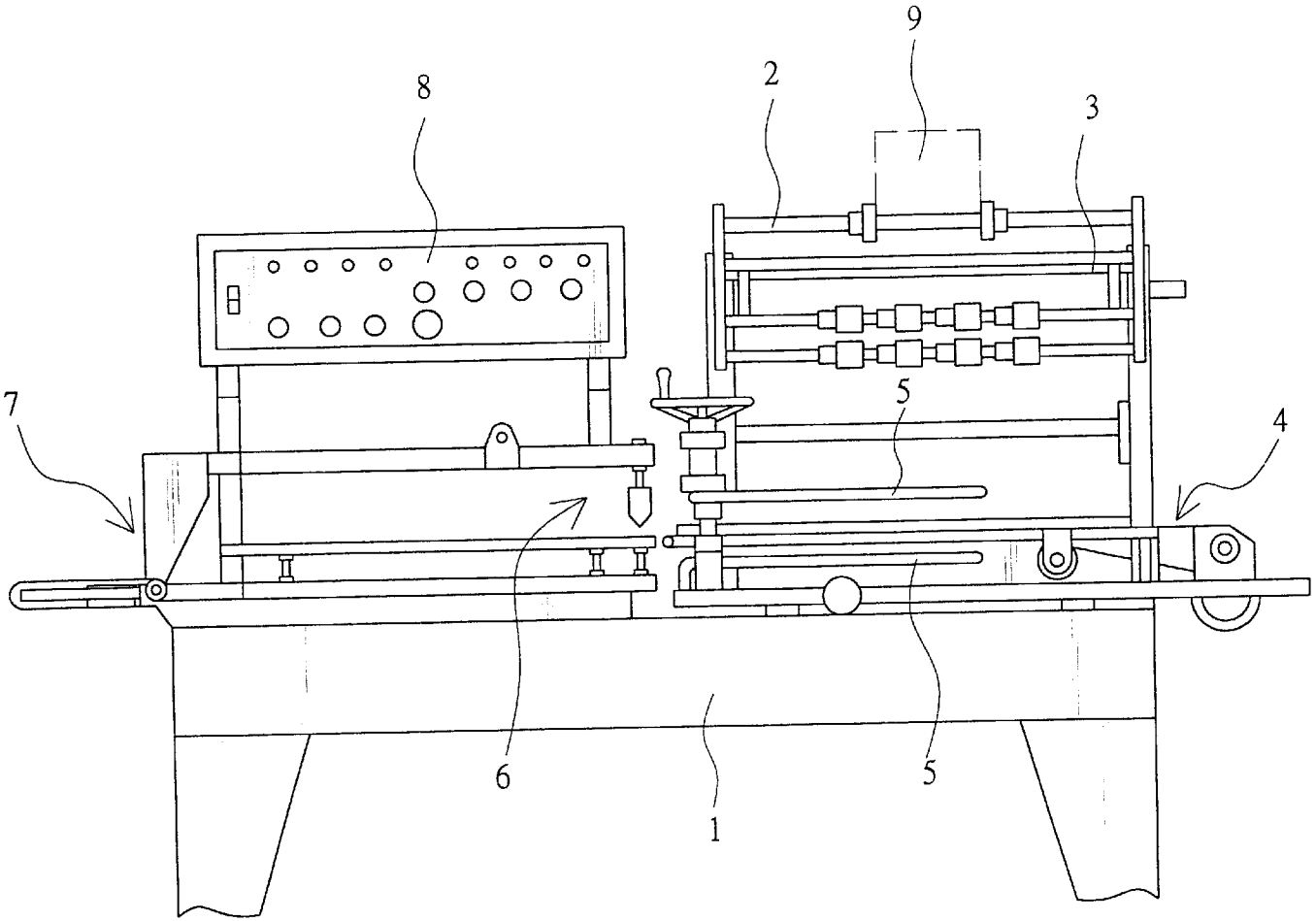
PRIOR ART FIG.1
FIG. 1 is an elevational view of a conventional packing, sealing and cutting machine.
Figure 2:
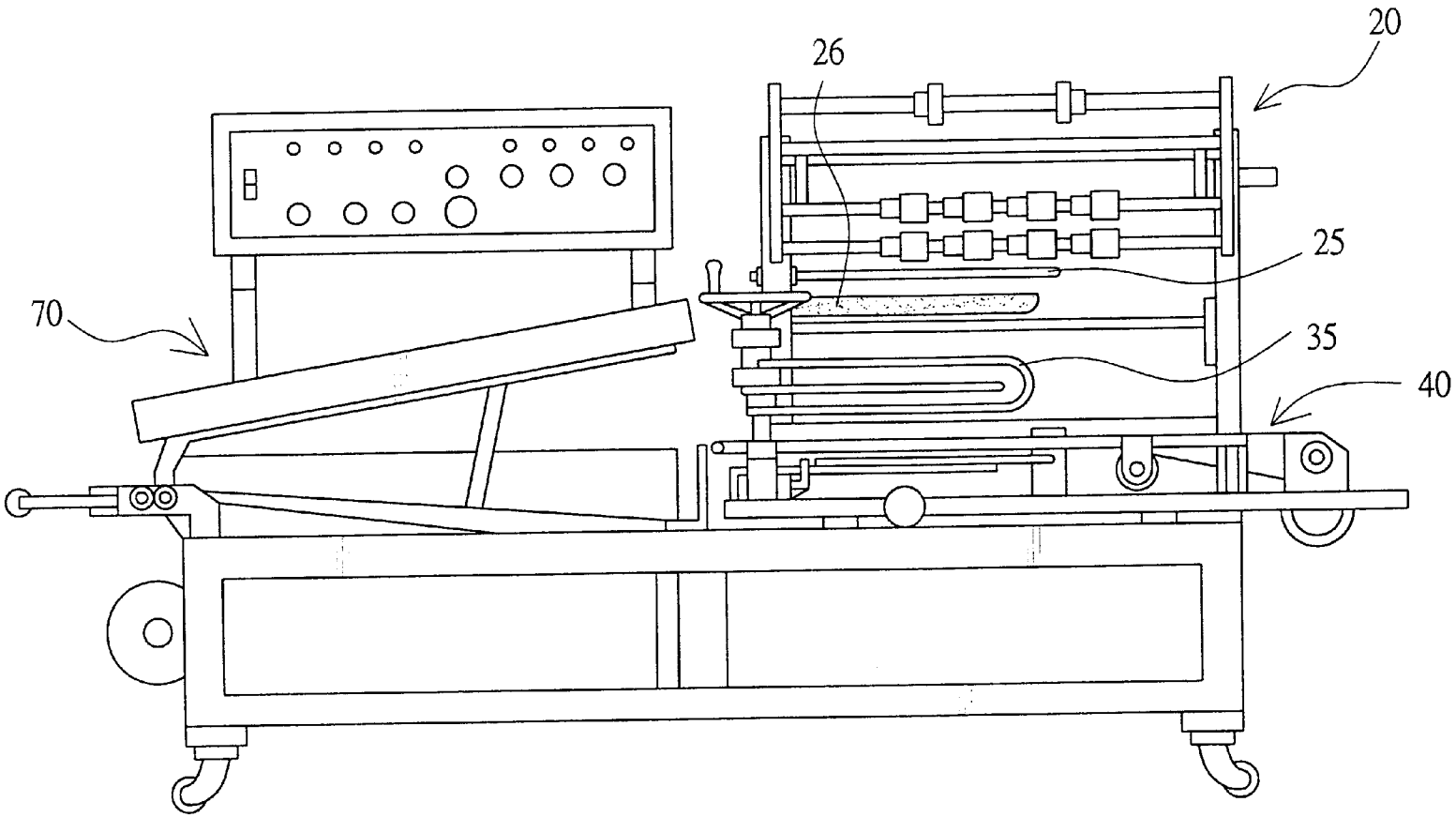
FIG. 2 is an elevational view of a packing, sealing and cutting machine in accordance with the present invention.

As shown in FIG. 2, the packing, sealing and cutting machine of the present invention comprises a film-delivery device 20 having a tension adjusting device, rolling needle wheel, separation rod 25 and electrostatic-eliminating rod 26; a front conveying device 40 having a teeth-adjusting device and row-type roller, oxygen-blowing device and an elevating rod 35; a film pulling device and sensing device and packing cutting knife driving device, the connection region for the packing, cutting device 70 being a circular arch-shaped, or the lateral side being provided with a side knife device.

Figure 3:
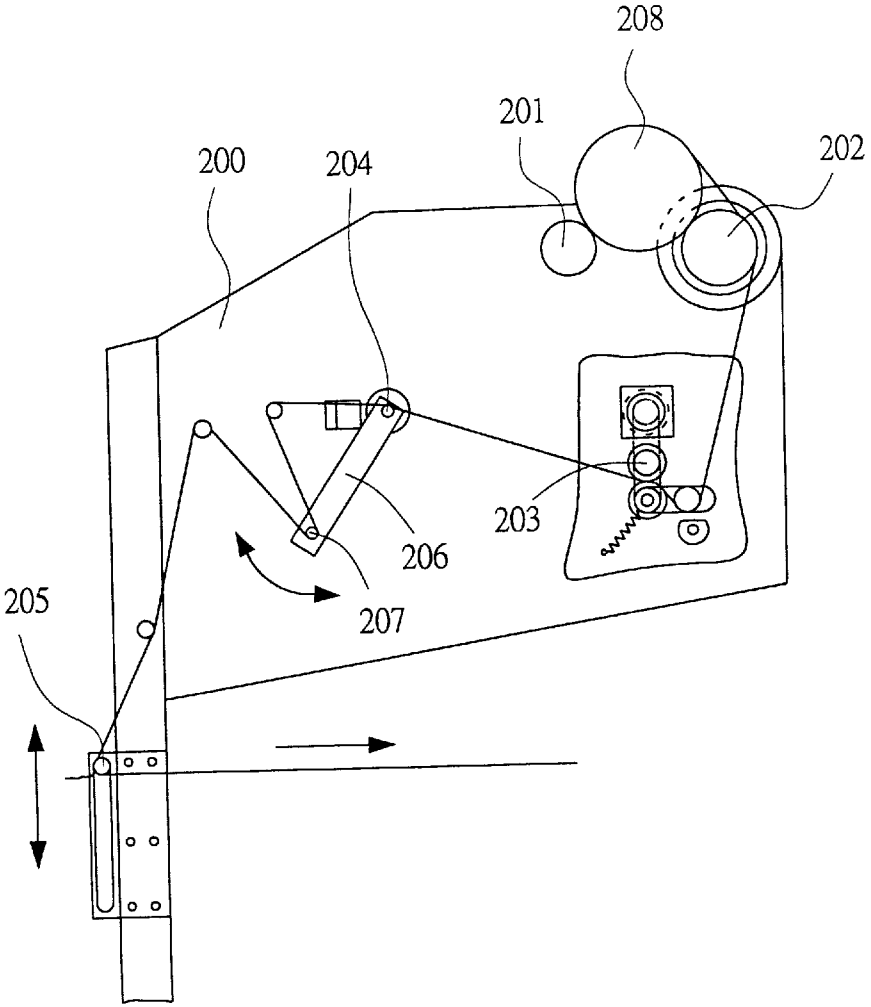
FIG. 3 is a sectional view of the film-delivery of a packing, sealing and cutting machine in accordance with the present invention.

As shown in FIG. 3, the film-delivery device is used to insert the film roll 208 into the gap formed between the adjustable rolling shaft 202 and the fixed rolling shaft 201 and the film of the film roll 208 is pulled out into the film clipping rolling shaft 203. Then the film is passed beyond the tension-adjusting shaft 204 and then via a plurality of film rotational shaft rod 205. The film then is delivered to the packing, cutting device.

Figure 4:
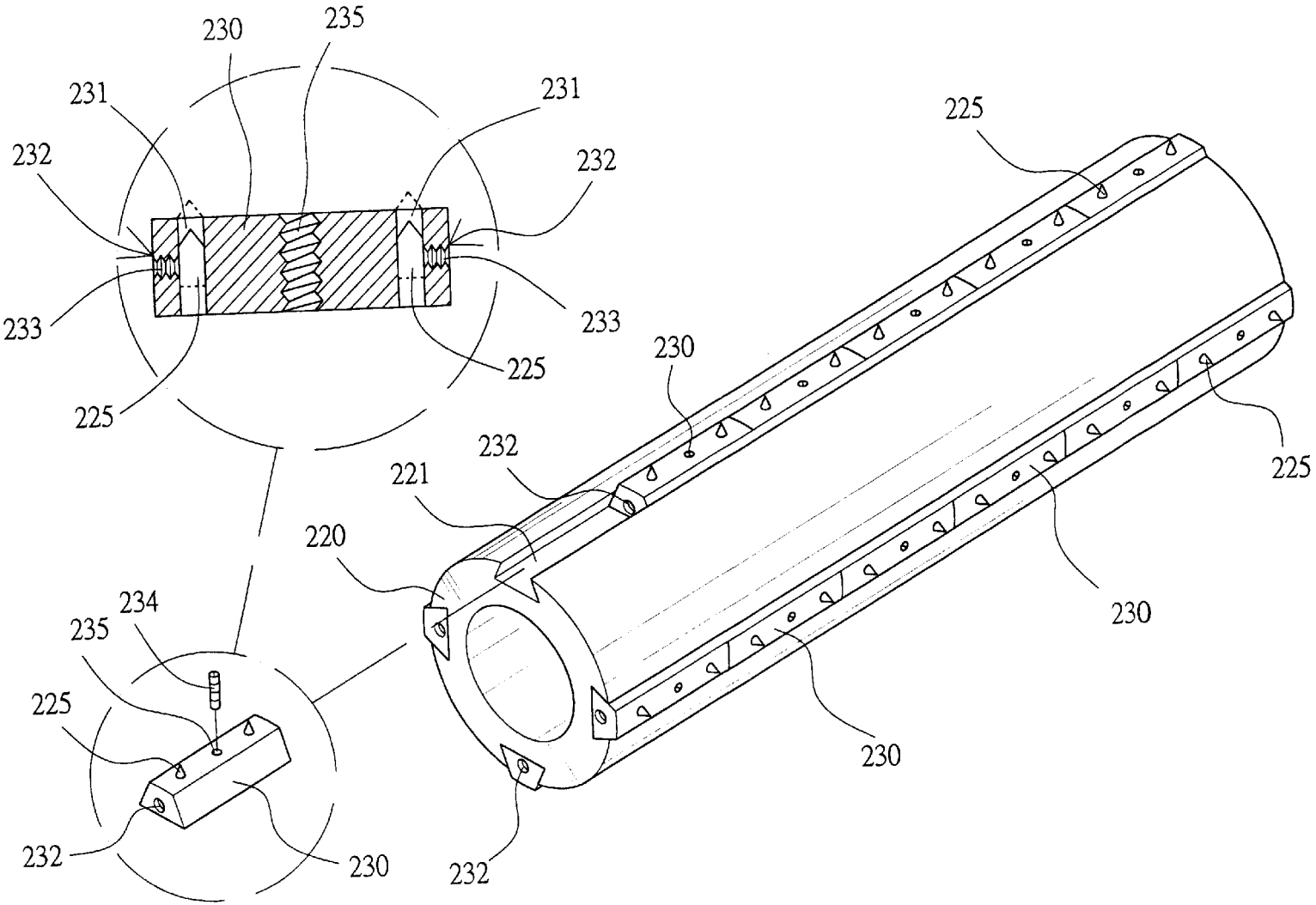
FIG. 4 is a perspective view of the rolling-needle wheel of the film-delivery in accordance with the present invention.
Figure 5:
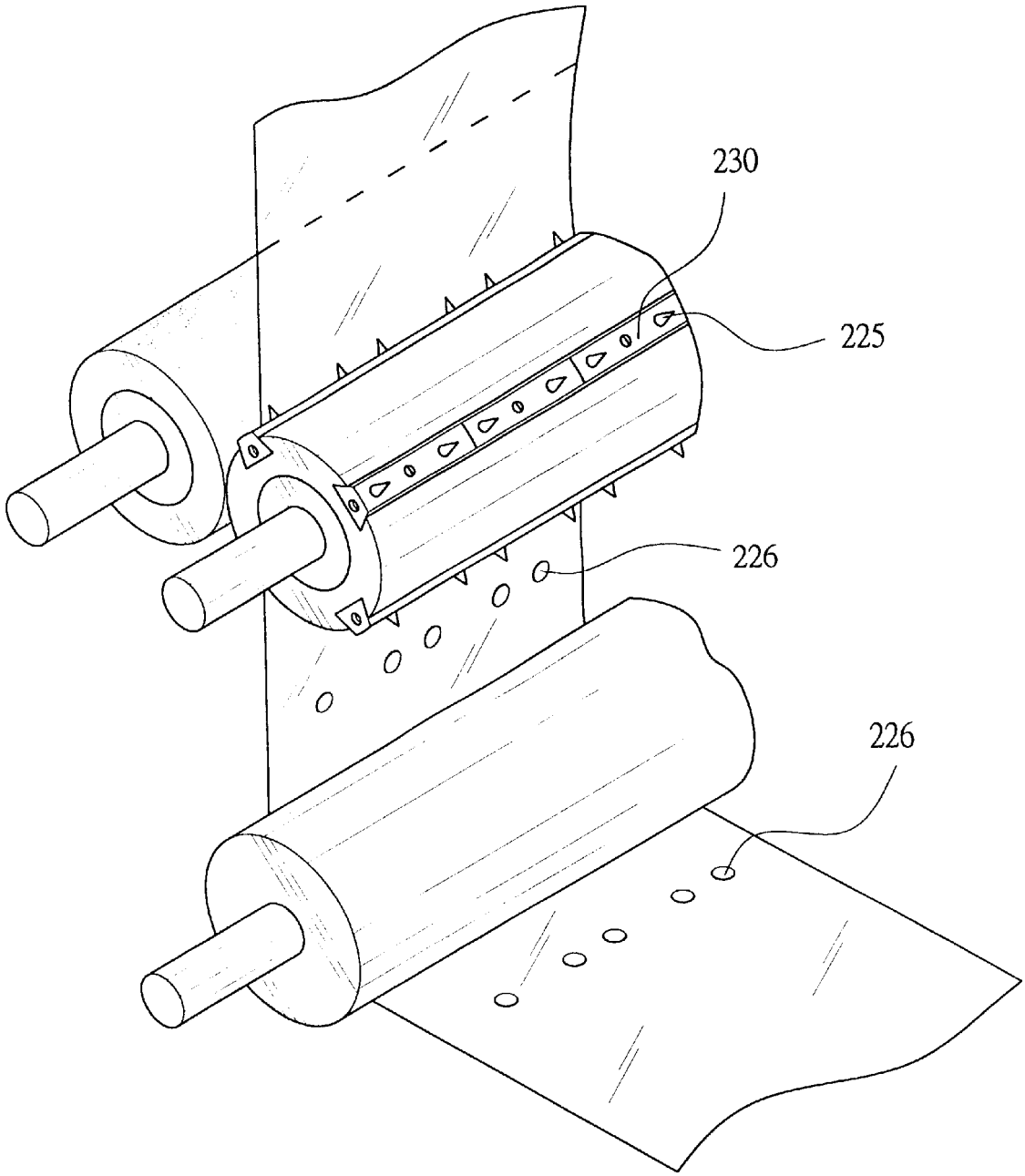
FIG. 5 is a schematic perspective view of the rolling-needle wheel of the film-delivery in accordance with the present invention.

Referring to FIGS. 4 and 5, the rolling needle wheel of the film-delivery device 20 includes a rolling needle shaft 220, a rolling needle seat 230, and rolling needle 20, wherein the rolling needle shaft 220 is provided with a plurality of dovetail slots 221 axially on the ring surface of the shaft 220. The rolling needle seat 230 has a conic shape cross-section and the top, close to the two ends of the seat 230, of the seat 230 is provided with a rolling needle hole 231 and the two end surface is provided with screws 232.

In accordance with the present invention, the plurality of the rolling needles 225 are correspondingly inserted into the rolling needle hole 231 of the rolling needle seat 230 and are secured by the bolt 233 via the screw 232. The rolling needle seat 230 is directly inserted into the dovetail slow 221 for mounting. In addition, bolt 234 is used to screw into the screw hole 235. The screw bolt 234 by means of an urging force via the rolling needle shaft 220 causes the rolling needle seat 230 and the bottom portion of the dovetail slot 221 to form an urging force for positioning.

The rolling needle wheel is secured by a rotating shaft and rotates by the rotation of the rotating shaft. Since every rolling needle 225 is positioned at the rolling needle hole 231 and the rolling needle seat 230 is mounted by engagement, at the rolling needle shaft 220, therefore, when the film is rolled, the rolling needle 225 will evenly cause a plurality of needle holes 226 on the film, which allows air to release rapidly through the needle holes 226 during sealing. Thus, the object of good packing is achieved.

In addition, in order to facilitate fabrication of the rolling needle shaft 220 and rolling needle seat 230, the dovetail slot 221 and the rolling needle seat 230 do not have a conic shape, but a screw bolt 234 is used to directly mount the same onto the rolling needle shaft 220.

As shown in FIG. 2, a separating rod 25 and a electrostatic eliminating rod 26 are provided in front of the triangular board for object packing the rods 25, 26 are inserted at the opened side of the film. They serve to separate and eliminate electrostatic during the film-delivery process so as to provide a smooth delivery of film. An elevating rod 35 is mounted at one side of the triangular board to elevate the film to avoid damage in the process of delivery an object for packing. Thereby, the effectiveness of packing is achieved.

Figure 6:
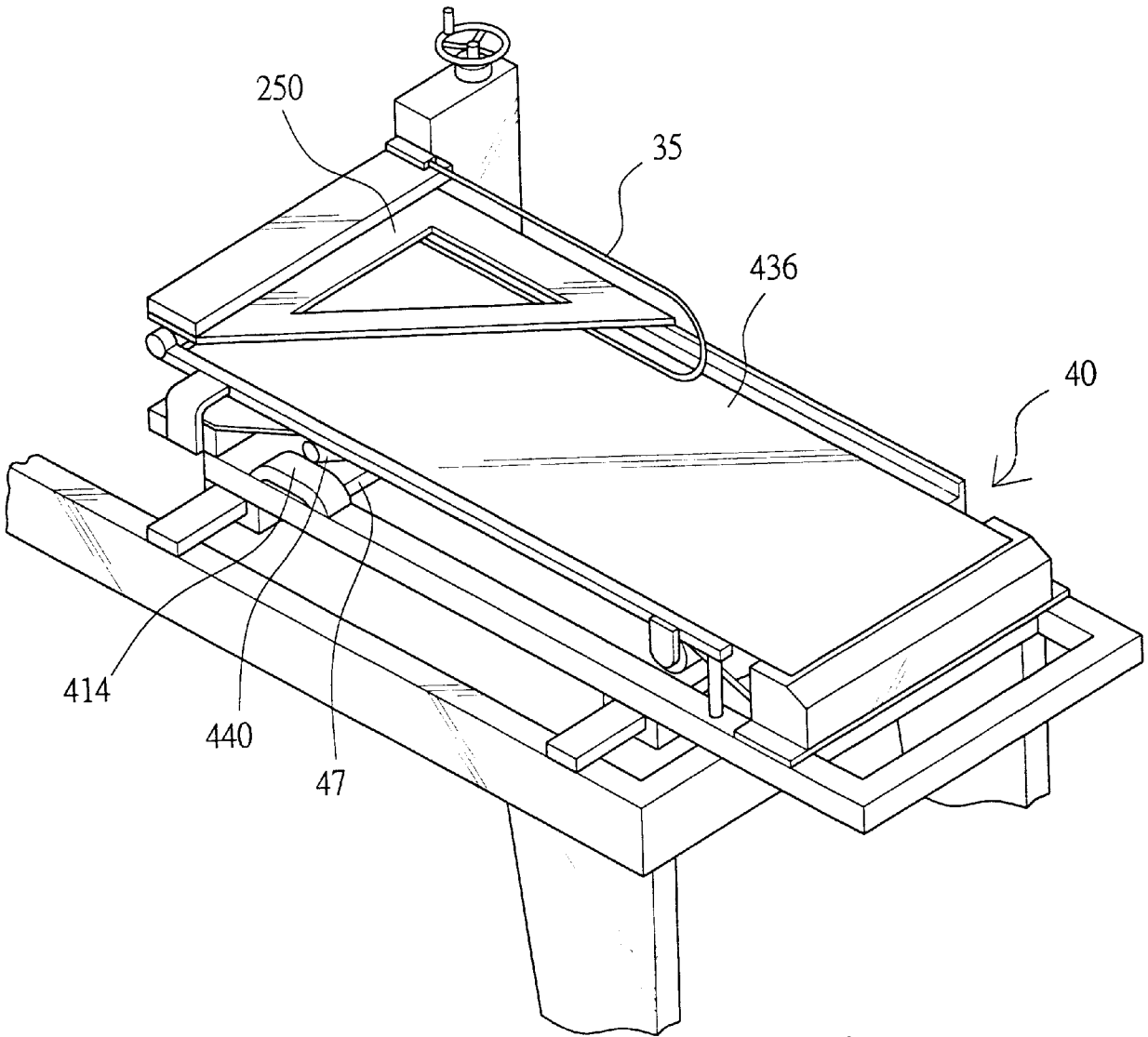
FIG. 6 is a perspective view of the front conveying seat of the present invention.
Figure 7:
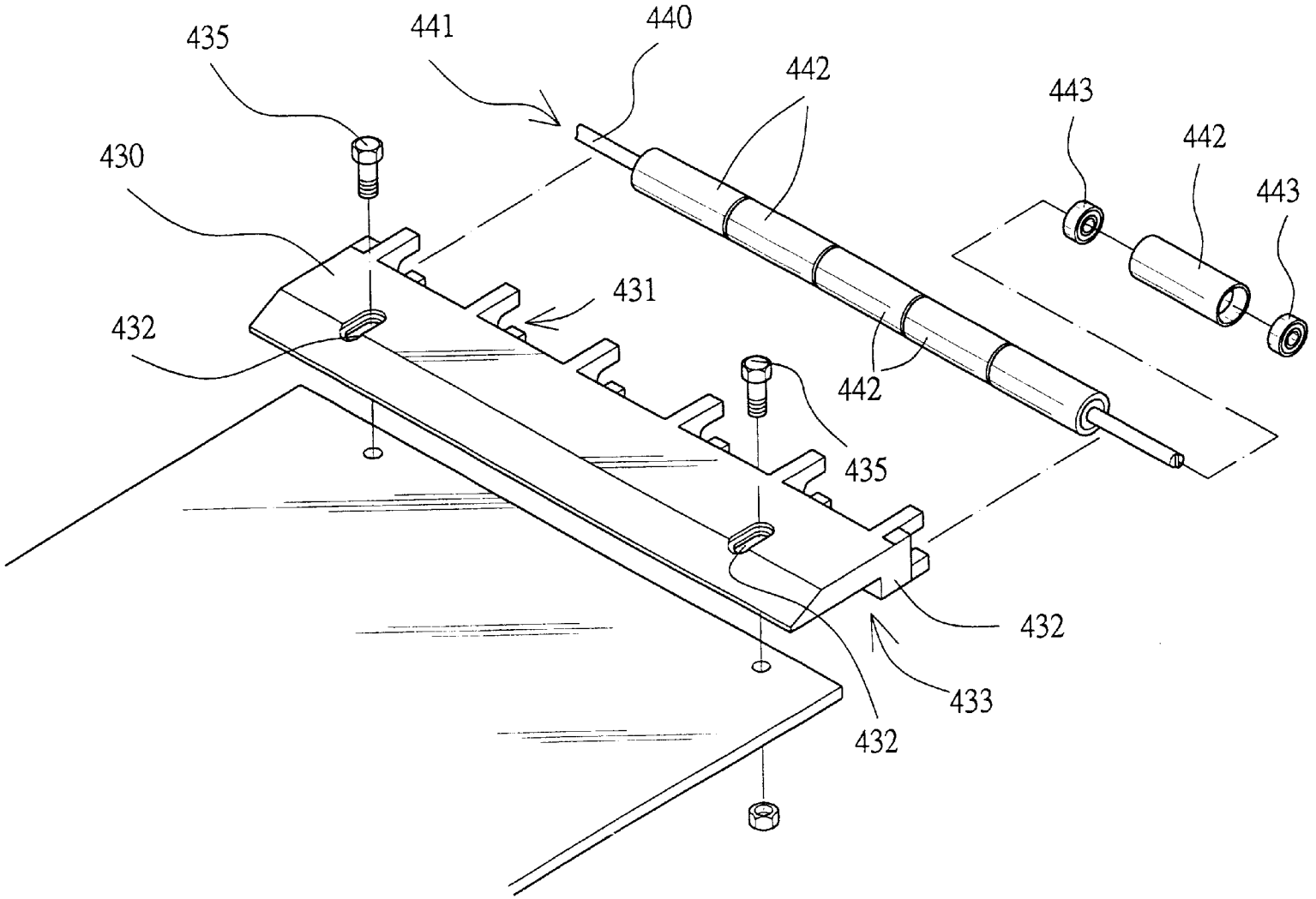
FIG. 7 is an exploded view of the row-type rolling-needle wheel of the front conveying seat of the present invention.
Figure 8:
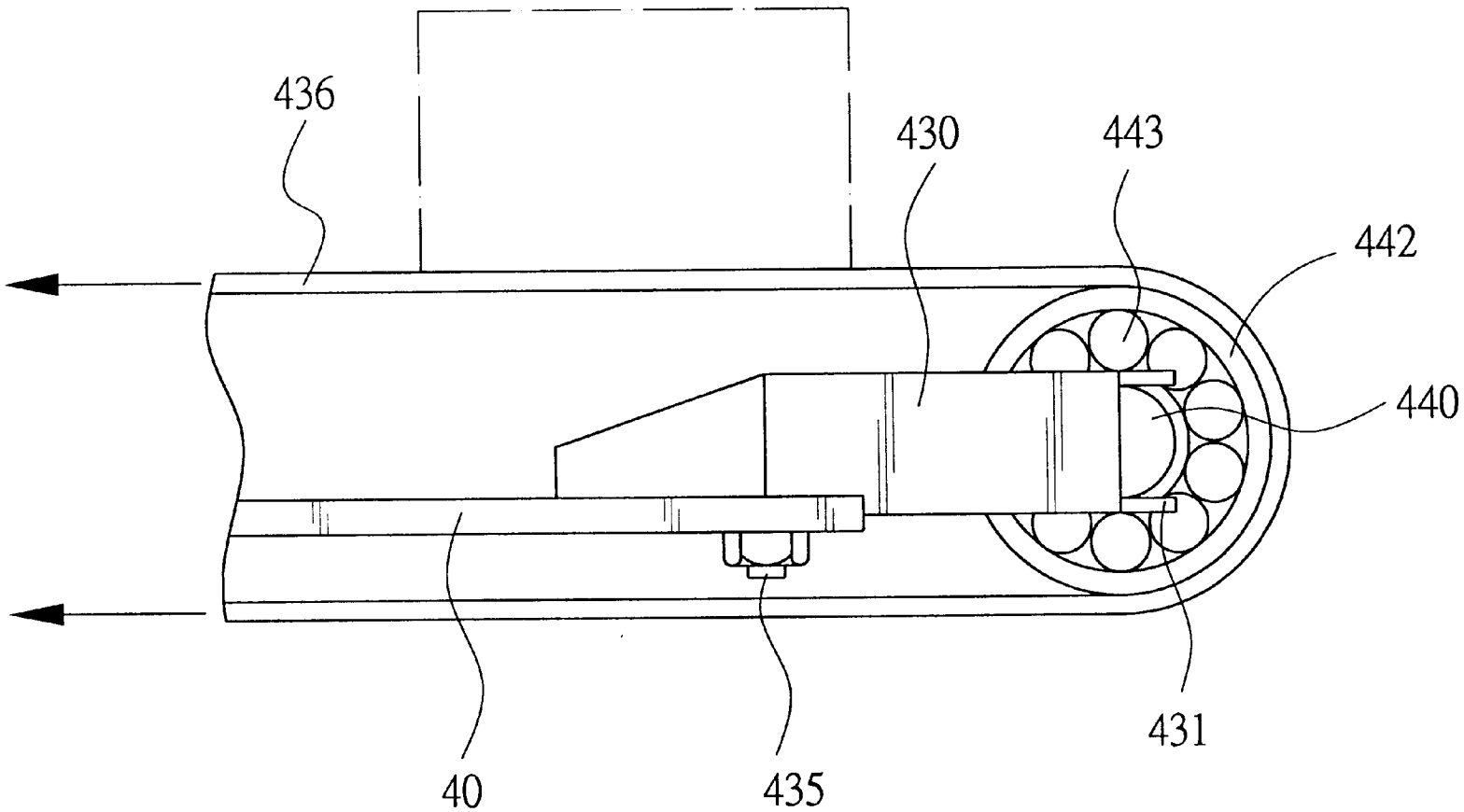
FIG. 8 is a front view of the row-type rolling-needle wheel of the front conveying seat of the present invention.

FIGS. 6, 7, and 8 show the conveyor supporting roller of the front delivery seat 40. The roller seat 430 has an end surface at the longer side thereof and is provided with a plurality of equally spaced-apart U-shaped side seat 431. The wide of the opening of the seat 431 is equal to the diameter of the side shaft 440. The end surface of the two short sides of the roller seat 430 is provided with a supporting surface 432. The angular surface 441 at the two ends of the side shaft 440 is exactly mounted thereon. In addition, a plurality of roller 442 having mounted with bearings 443 at the end thereof has a width equal to the width of the two abutted U-shaped side seat 431 on the roller seat 430. These rollers 442 are provided at the side shaft 440 and the entire roller module is mounted onto the U-shaped side seat 431. Two long holes 432 are provided on the roller seat 430 and the bottom surface of the roller seat 430 is provided with a stepped-like flat surface 433 which can be mounted onto the machine and secured with screw nuts 435.

When the roller module is mounted onto the conveyor 436, as the side shaft 440 is supported by the U-shaped side seat 431, the conveyor 436 will not deform and or cause a biased movement.

Figure 9:
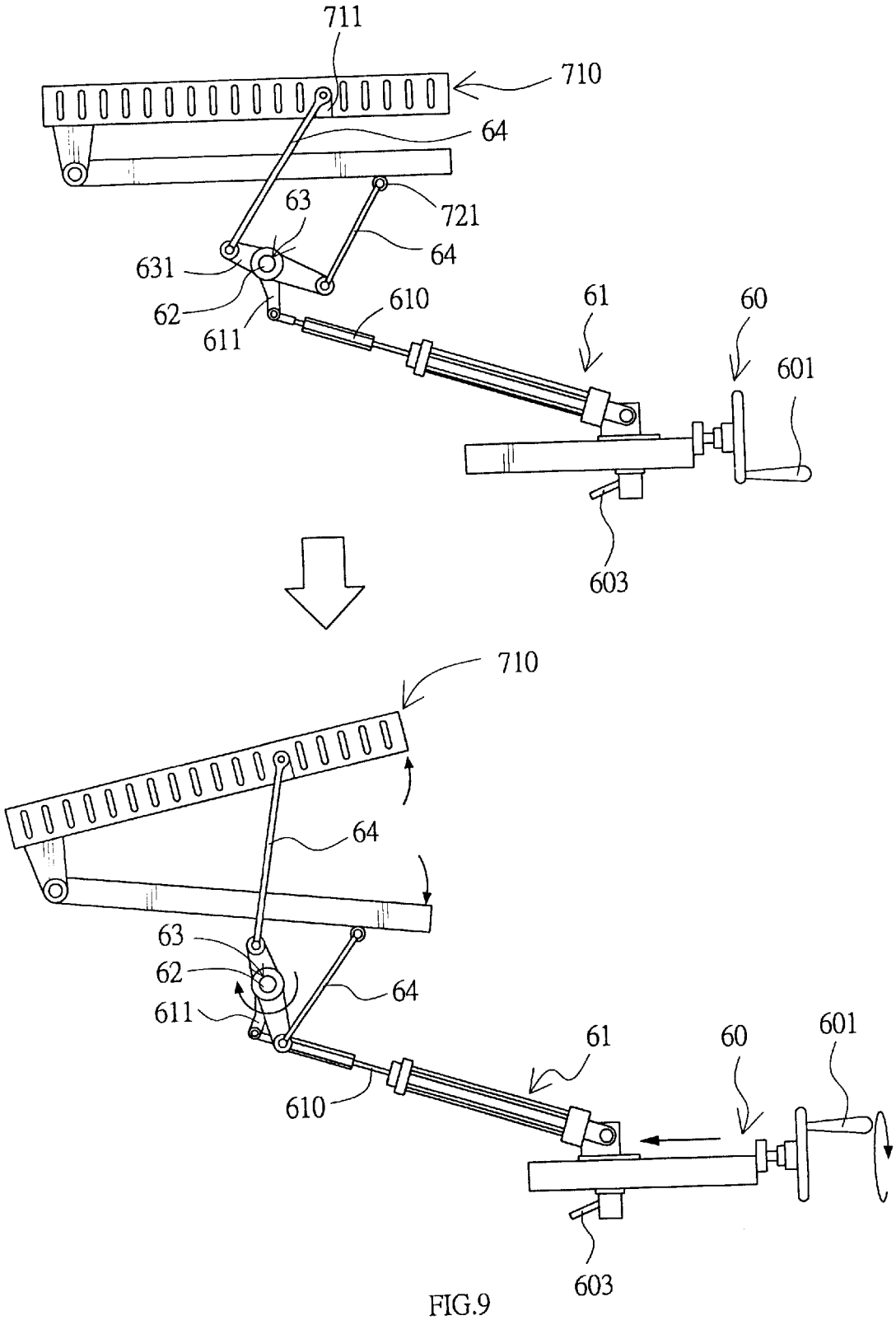
FIG. 9 is a schematic view of the sealing and cutting knife driving device of the present invention.
Figure 10:
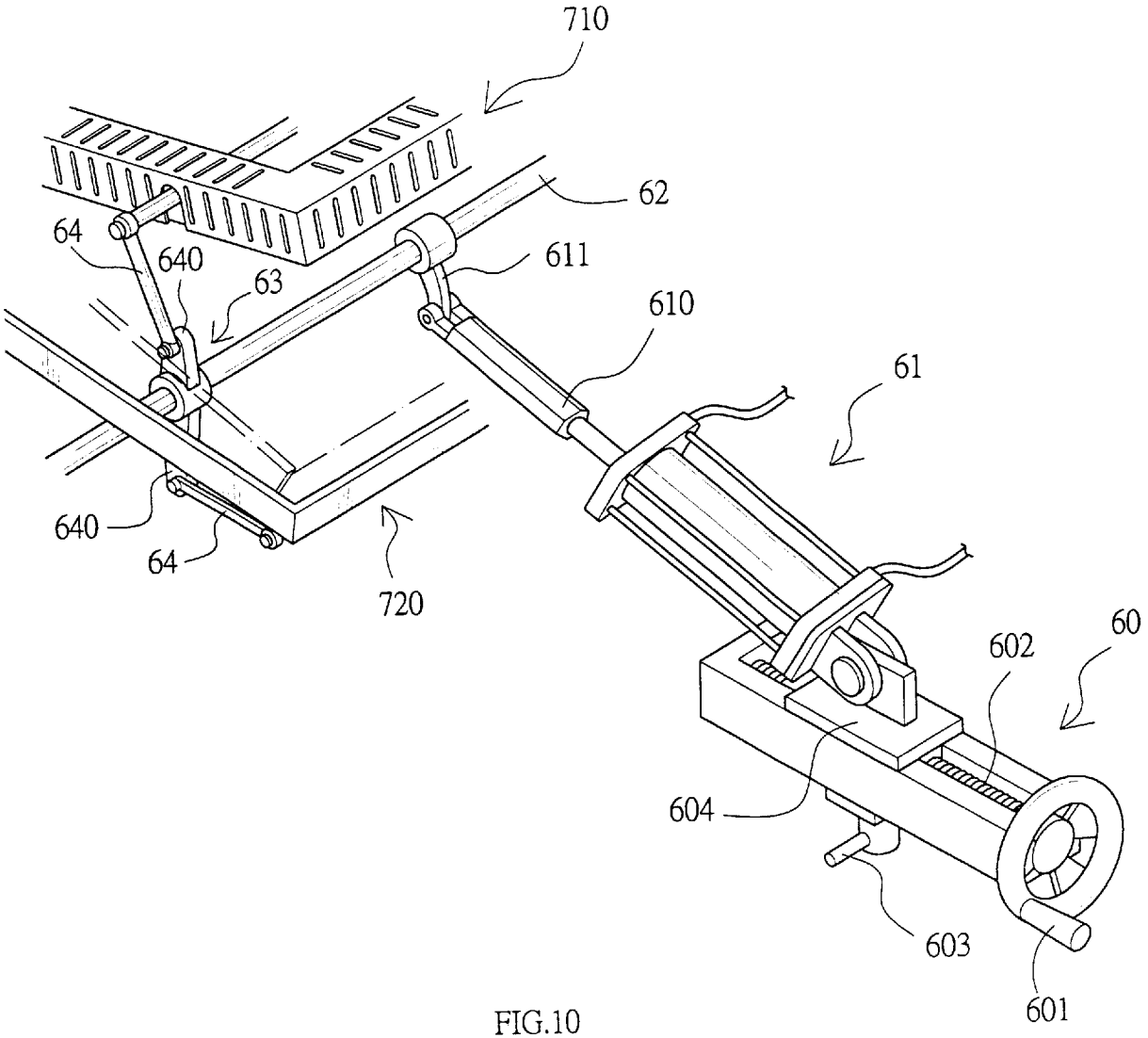
FIG. 10 is a perspective view of the sealing and cutting knife driving device of the present invention.

As shown in FIGS. 9 and 10, the driving device of the sealing and cutting device 70 includes the adjusting seat 60, an air pressure cylinder 61, a rotating shaft 62, a linking arm 63, a rod 64, and a sealing and cutting knife, wherein (a) the adjusting seat 60 is a rotating body and includes a rotating wheel 601 to rotate a screw rod 602, and a frame seat 604 located at the screw rod 602 is moved accordingly, and the bottom end of the seat 60 is provided with a securing rotating disc 603 for the mounting of the frame seat 604;

(b) the air pressure cylinder 61 has an end terminal pivotally mounted at the frame seat 604 and the air pressure rod 610 at the front end thereof passes the linking rod 611 and then secured to the rotating shaft 62;

(c) the rotating shaft 62 is pivotally mounted to the shaft rod within the machine;

(d) the interlinking arm 63 is mounted at the two lateral sides of the rotating shaft 62 and has an arm 630 with two protruded ends;

(e) the rod 64 has one end pivotally mounted at the arm 640 and has the other end pivotally connected to the sealing, cutting knife;

(f) a sealing, cutting knife is used to seal and cut the contracted film, and has one side being provided with an external protruded disc.

In accordance with the present invention, the adjusting seat 60 is mounted at the bottom end of the machine and the adjusting seat 60 is mounted onto the rotating shaft via the air pressure cylinder 61, the interlinking rod 610, so that the front and rear displacement of the air pressure rod 61 drives the interlinking rod 611 and a swinging movement is formed, and the rotating shaft 62 is reciprocating. Thus the interlinking arm 63 at the side of the rotating shaft 62 will reciprocate. As a result, when the four corresponding rods 64 are respectively mounted at the arm 631 and the upper and lower end of the sealing, cutting seat, the rod 64 will rotate in relation to the interlinking arm 63 so as to produce a pulling and a pushing force, and the sealing and cutting seat forms a continuing open and closing type of sealing and cutting action. In view of the above, the size of the movement of the sealing and cutting seat is controlled by the reciprocation rotation of the rotating shaft 62, and the rotating shaft 62 is interlinked by the air pressure cylinder 61. Thus, the reciprocation rotation of the rotating shaft 62 is fixed if the retraction length of the air pressure rod 610 in relation to the air pressure cylinder 61. As a result, the change of the relative position of the air pressure cylinder 61 can change the angle of rotation of the rotating shaft 62, so that the angle of open and close of the sealing and cutting seat can be changed. When the object is small, the rotating wheel 601 is rotate to drive the screw rod 602 to cause the frame seat 604 and the air pressure cylinder 61 to move backward, then the distance of the air pressure rod 610 is shorten and the object of adjusting the sealing cutting seat is attained. The rotating of the rotating disc 603 can position the frame seat 604 and to avoid the frame seat 604 and the air pressure cylinder 61 to move. Thus the adjusting distance of the adjusting seat 60 will not move. Besides, when the packing object is big, the adjusting seat 60 causes the air pressure cylinder 61 to move forward such that the angle of open and close of the sealing and cutting changes larger so as to provide sealing and cutting action of the upper and lower sealing and cutting knife 710, 720.

Figure 11:
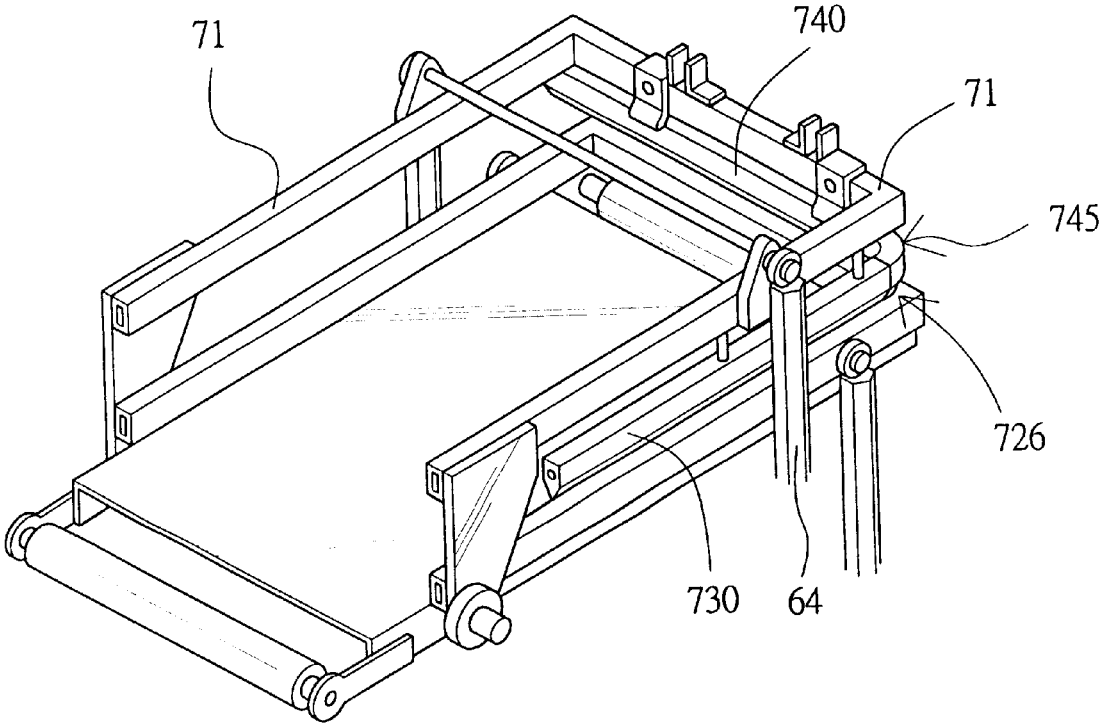
FIG. 11 is a schematic perspective view of the sealing and cutting knife driving device of the present invention.
Figure 12:
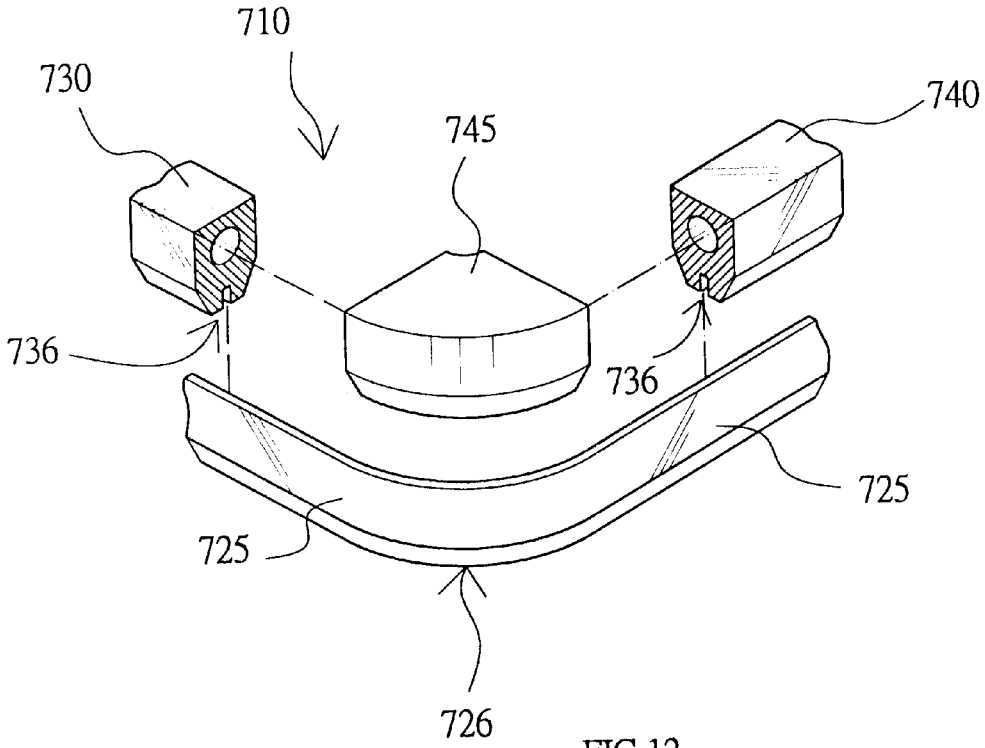
FIG. 12 is a perspective view of the sealing and cutting knife of the present invention.

Referring to FIGS. 11 and 12, the sealing and cutting device is provided with a sealing and cutting knife seat 71 driven by the driving shaft 64 of the driving system 60, and the bottom section of the sealing and cutting knife seat 71 is provided with a sealing and cutting knife 710. The sealing and cutting knife 710 includes a vertical sealing and cutting knife 730, a horizontal sealing and cutting knife 740 and a circular arched section 745, which is an L-shaped sealing and cutting knife 710. The center of the cross-section of the knife 730 is provided with a through hole 735 for the mounting of an electrical heater. The sealing and cutting knife device is characterized in that the vertical, the horizontal sealing and cutting knife 730 and 740, and the bottom end of the circular arch-shaped portion, 745 are provided with corresponding slot 736 being mounted with a blade 725. The blade 725 has a curved body and a circular arch-shaped end 726 corresponds to the circular arch-shaped section 745. The cross-sectional area of the blade 725 is smaller than that of the vertical and horizontal sealing and cutting knife 730, 740, therefore, it is easy to manufacture a smooth circular arch-shaped angle. In addition, there is a gap at the connection of the vertical and the horizontal sealing and cutting knife 730, 740, but the blade 725 does not affect by the gap but to provide an effective sealing and cutting opening. For maintenance, the blade 725 can be easily unloaded.

Figure 13:
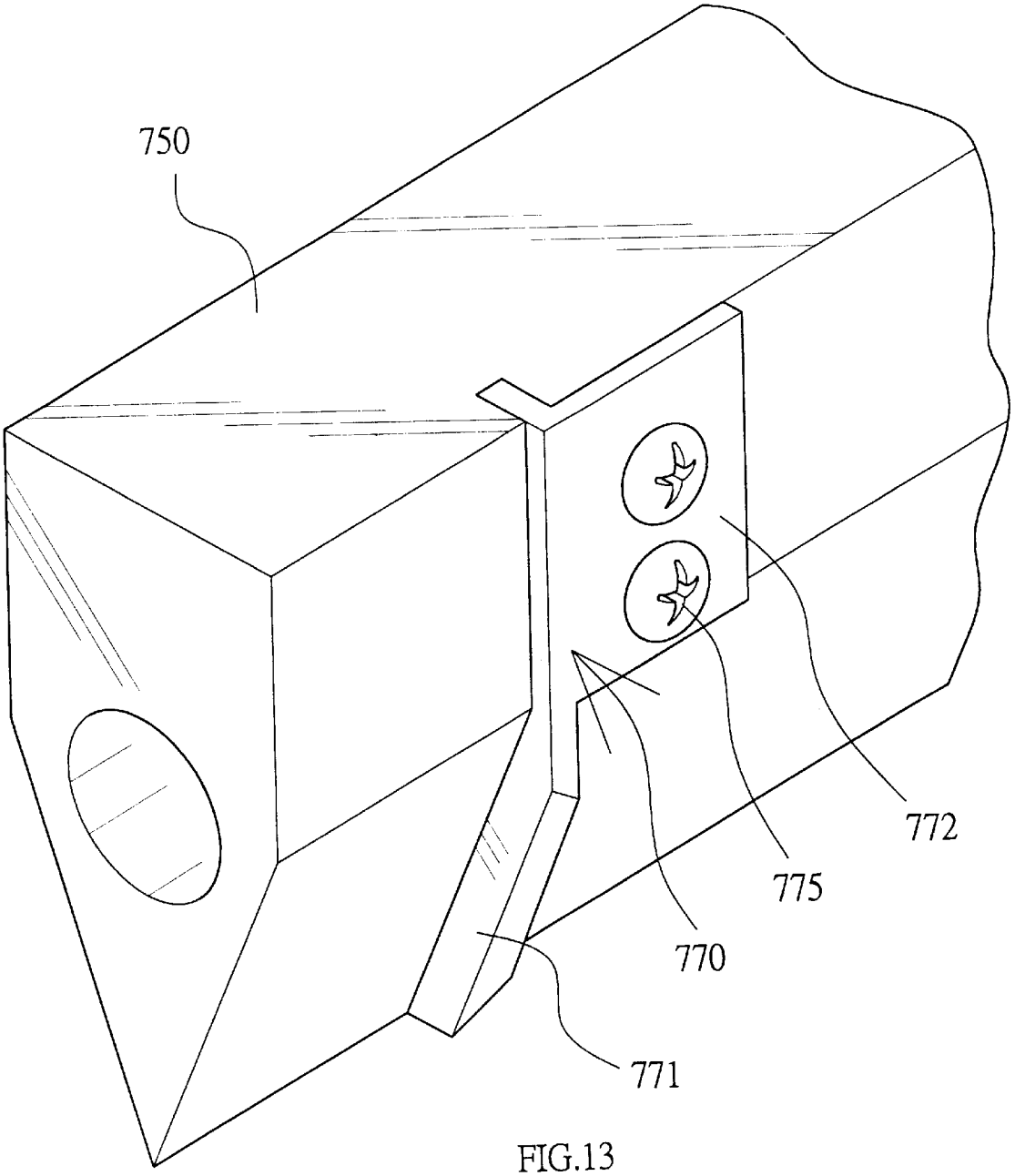
FIG. 13 is a perspective exploded view of side knife of the sealing and cutting knife of the present invention.
Figure 14:
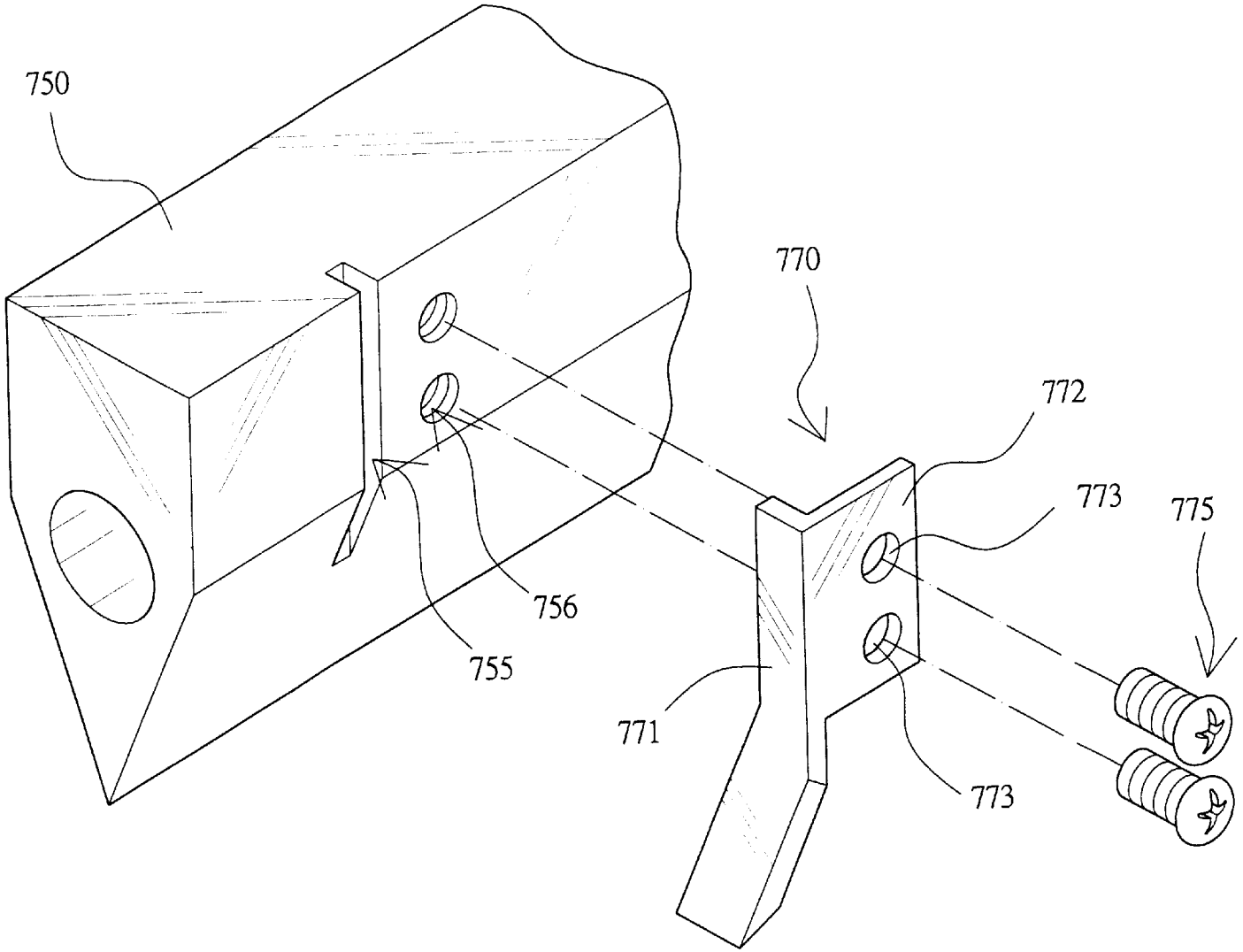
FIG. 14 is a perspective view of the side knife of the sealing and cutting knife of the present invention.
Figure 15:
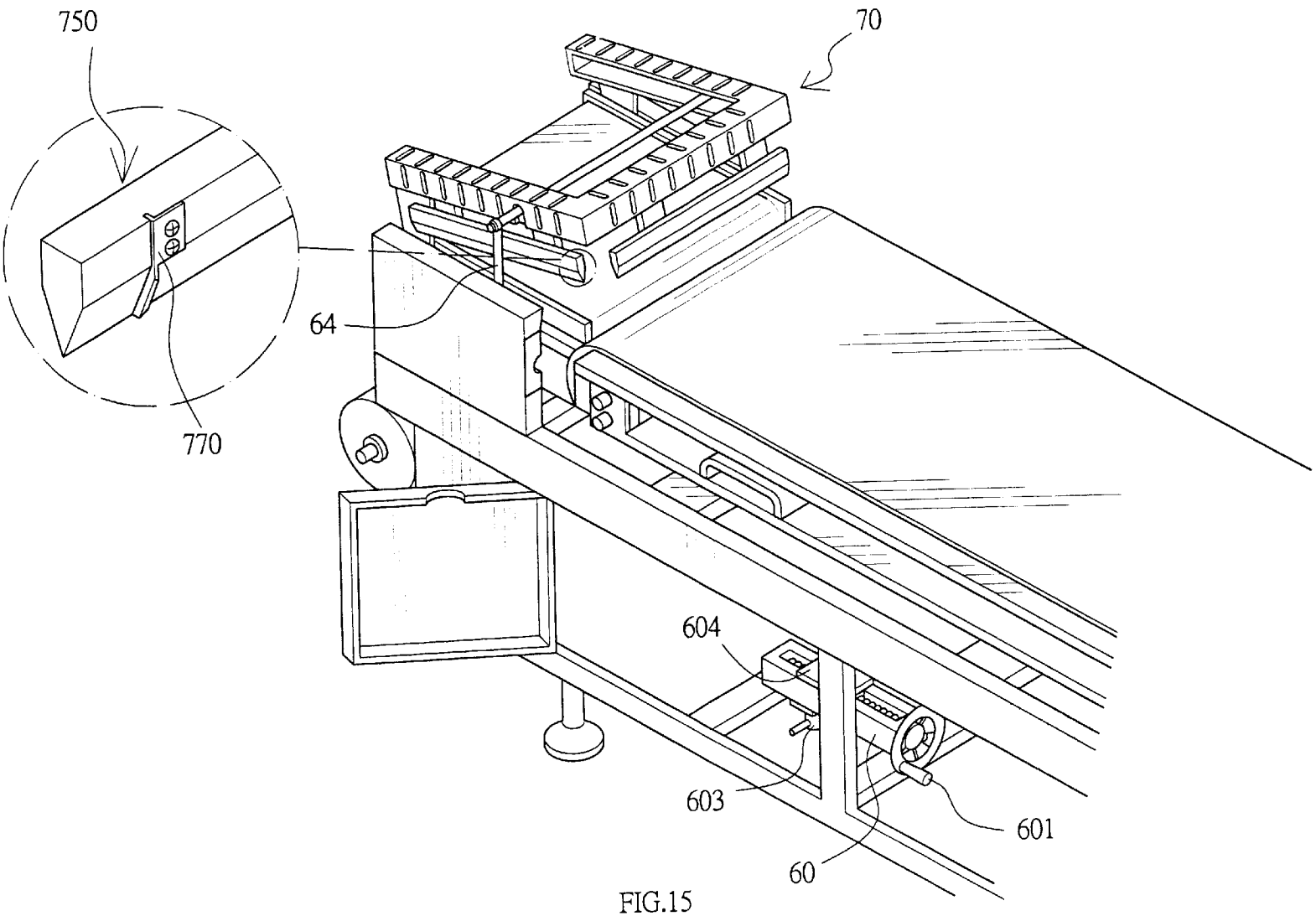
FIG. 15 is a perspective view of the sealing and cutting knife of the present invention.

As shown in FIGS. 13, 14, and 15, there is shown a tearing edge device of the sealing and cutting knife device including a vertical sealing and cutting knife 750 and a lateral knife 770, wherein the inner edge of the vertical sealing and cutting knife 750 is provided with a recess 755 and a plurality of screw holes 756, and the lateral knife 770 can be inserted with a blade 771 and a securing plate 772 with a plurality of through holes 773. By means of a plurality of screw bolts 775, the lateral knife is secured at the recess 755 at the inner side of the vertical sealing and cutting knife 750.

Figure 16:
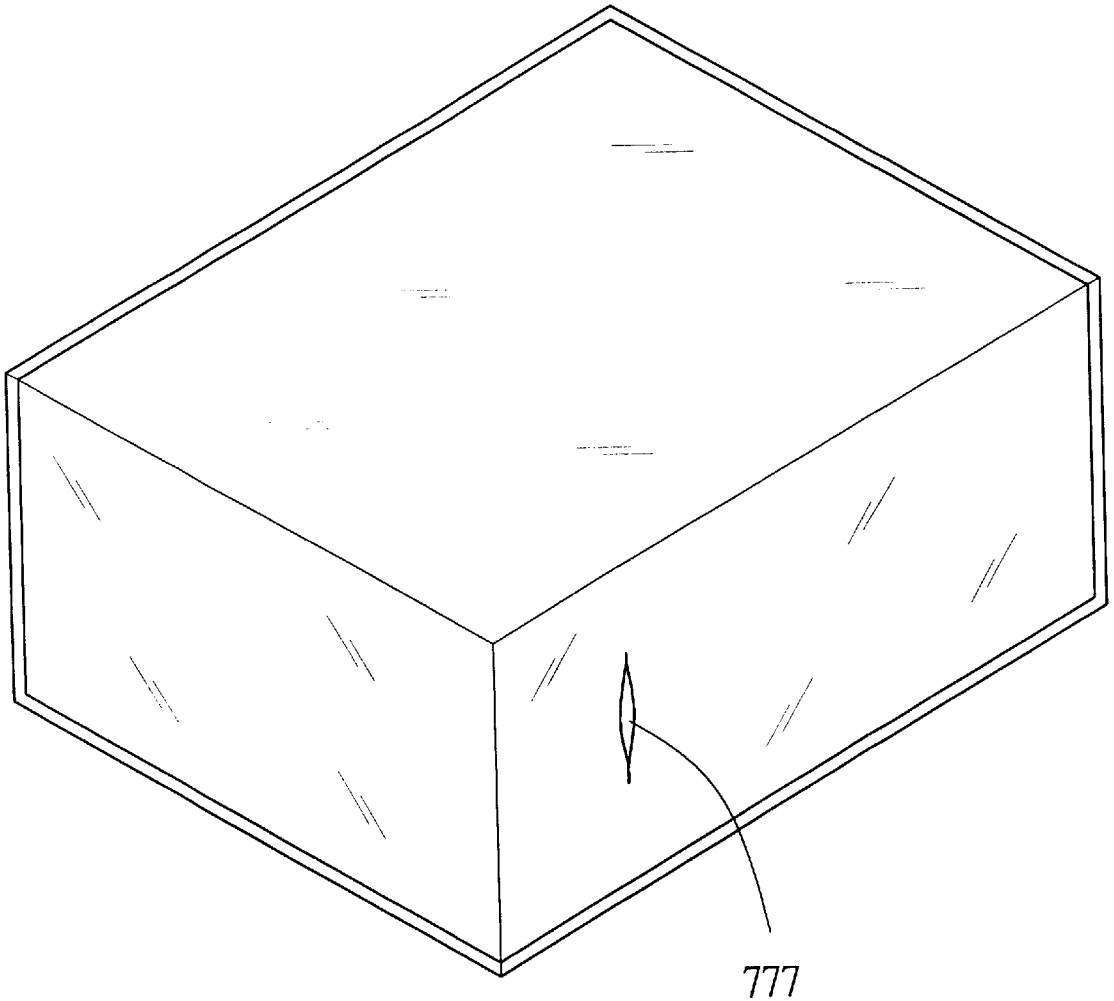
FIG. 16 is a schematic view of the packed object in accordance with the present invention.
Figure 17:
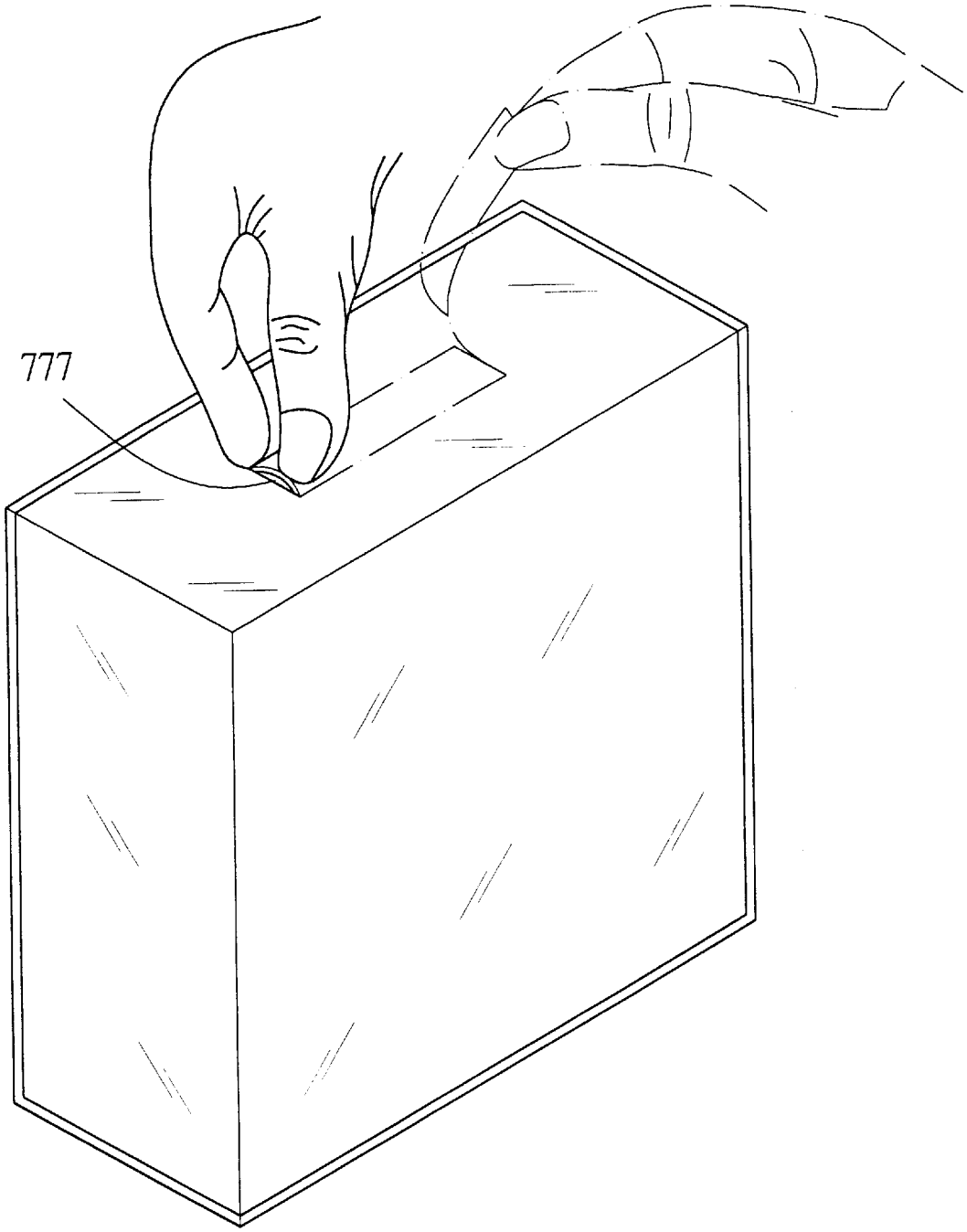
FIG. 17 is a schematic view of the packed object in accordance with the present invention.

The to-be packed object is delivered to the interior of the contraction film via the delivery platform and via another conveyor to the horizontal sealing and cutting knife 760. The horizontal sealing and cutting knife 760 and the vertical sealing and cutting knife 750 shall cut downward and the conveyor will temporary stop. After the film has been sealed and cut,.the opened portion of the film is proceeded to a cutting action and a heat sealing action. A tearing edge 777 (as shown in FIG. 16) is formed at the heat sealed portion, which is the mark formed by the lateral knife 770. Thus the film will be filly shrunk and adhered together with the object forming a packed object. The tearing edge 777 is slightly opened and curved upward (as shown in FIG. 17), thereby indicating to the user the tearing mark of the tearing edge 777 and facilitating the user to tear off the shrunk film.

Although the invention has been explained in relation to its preferred embodiment, it is to be understood that many other possible modifications and variations can be made without departing from the spirit and scope of the invention as hereinafter claimed.

I claim:

1. An automatic packing, sealing, and cutting machine for plastic film comprising a film delivery device, a front conveying seat device, a rear conveying seat device, a sealing and cutting knife and a control box, wherein a rolling-needle wheel device of the film delivery device includes a rolling-needle shaft, and a plurality of rolling-needle seats, and a plurality of rolling needles, and the rolling-needle shaft has a ringed-surface mounted with a shaft tube axially provided with a plurality of dovetail slots; the rolling needle seat has a conic shaped cross-section having an individual rolling-needle hole and a center screw hole, and close to the two top end and the two end faces are provided with second screw holes to connect with the rolling-needle hole; thereby the rolling needle is placed into the rolling needle hole of the rolling needle seat and said second screw hole is mounted with screw bolt and the rolling needles are secured at the rolling needle hole, and a plurality of rolling needle seats are inserted into each of the dovetail slots, wherein the dovetail slot and the rolling-needle seat are mounted by means of a bolt in the center screw hole, said sealing and cutting knife comprising of an L-shape knife connected by a circular arched section provided with corresponding slot being mounted with a blade, and the blade has a curved body and a circular arch-shaped end corresponds to the circular arch-shaped section.

* * * * *